United States Patent [19]

Fonda

[11] Patent Number: 4,678,963

[45] Date of Patent: Jul. 7, 1987

[54] SHADOW MASK FOR A COLORED IMAGE TUBE AND IMAGE TUBE COMPRISING THE SAME

[75] Inventor: Carlo L. Fonda, Anagni, Italy

[73] Assignee: Videocolor, Montrouge, France

[21] Appl. No.: 673,825

[22] Filed: Nov. 21, 1984

[30] Foreign Application Priority Data

Nov. 25, 1983 [FR] France ..... 83 18853

[51] Int. Cl.[4] ..... H01J 29/07

[52] U.S. Cl. ..... 313/405; 313/467

[58] Field of Search ..... 313/402–405, 313/407, 408

[56] References Cited

U.S. PATENT DOCUMENTS 3,524,973 8/1970 Rigdon ..... 313/405
3,808,493 4/1974 Kawamura et al. ..... 313/404
4,308,485 12/1981 Ignazio ..... 313/407

FOREIGN PATENT DOCUMENTS 2713246 10/1978 Fed. Rep. of Germany ..... 313/405

OTHER PUBLICATIONS

Patents Abstracts of Japan, vol. 6, No. 144, Aug. 3, 1982, p. 1022E122.

*Primary Examiner*—Palmer C. DeMeo
*Assistant Examiner*—Sandra L. O'Shea
*Attorney, Agent, or Firm*—Pollock, Vande Sande & Priddy

[57] ABSTRACT

In colored image tube having a perforated mask for the selection of colors in order that an electron beam intended for one color only reaches on the screen the luminescent material of that color. This mask presents an edge fixed to a frame through the intermediary of bimetallic strips. This frame is integral with the internal face of the glass wall of the tube adjacent to the screen. The bimetallic strips between the edge of the mask and the frame are flat. When the edge of the mask is inside the frame, one of the ends of each strip is welded to an internal projection of the frame and the other end to the edge of the mask in order to provide a space between the corresponding arm of the frame and the edge.

7 Claims, 12 Drawing Figures

SHADOW MASK FOR A COLORED IMAGE TUBE AND IMAGE TUBE COMPRISING THE SAME

BACKGROUND OF THE INVENTION

The present invention concerns a shadow mask or color selection electrode for a television image tube, or display (visualization) in color. It concerns, more particularly, means for attaching the mask to its support framework that are disposed in such a way as to reduce the initial distortion (the swelling or bulging) of the mask under the effect of the heat generated by its electron bombardment.

A shadow-mask tube is generally formed of a glass envelope comprising a front panel (or plate) having a rectangular form, surrounded by a lateral wall in the form of a skirt, which is sealed at a part called the "conical" part which tapers and finishes with a tubular neck, housing at the end an assembly of three electron guns. Around this neck, horizontal and vertical electromagnetic deflectors are provided, allowing to carry out the sweep of the luminescent screen.

This screen, formed of luminescent material of three primary colors, red R, blue B, and green V, is deposited on the internal face of the plate. In a type of tube where the electron guns emit three parallel electron beams situated in a single horizontal plane, this screen is constitued by a repetitive succession of three vertical bands of luminescent material of three different colors R, V, B.

The color selection electrode is constituted by a metal surface provided with a great number of oblong (or elongated rectangular) openings; it is called a shadow-mask and is disposed on the path of the three electron beams adjacent to, and substantially parallel with, the screen. This mask has the effect of allowing to pass only that part of each electron beam which is directed towards a single band of luminescent material R, V and B, so that one beam is intended to hit the green bands, another beam only reaches the blue bands B and the last beam only bombards the red bands R; the selection is obtained due to the difference of the incident angles of the beams at the site of the slots. But the major part (about 80%) of the electrons of each beam hits the mask without crossing through the slots. This means that a rapid heating of the part of the mask swept by the beams occurs.

Since the mask must, during the manufacturing of the tube, be removed and put back into place several times and, furthermore, be capable of supporting predetermined mechanical shocks and vibrations, without undergoing permanent distortions or displacements, it is generally supported by means of a fixed metal frame which is, preferably, constituted by a profiled piece having an L-shaped cross-section and a thickness substantially greater than that of the mask (by 10 to 15 times, for example). The thickness of the mask is generally comprised between 100 and 200 micrometers, and that of the frame between 2 and 3 millimeters. These values depend, of course, upon the dimensions of the screen.

Due to this fact, the thermal inertia of the frame is much higher than that of the mask; this frame is thus heated only much more slowly. Therefore, the shadow mask is, once the tube operates, heated much more quickly than the heavy and thick frame. This frame itself is touched only slightly by the electrons, which generally contact it only in the vicinity of the beginning and the end of each line sweep and each frame sweep. Consequently, it is mainly heated from the mask and it only reaches its equilibrium temperature much later than this mask. A swelling or bulging of the mask is thus observed, the central part of which approaches the screen and the edges of which, being welded to the frame, are fixedly maintained in position by it. The frame is itself secured to the skirt of the front panel only by conventional assembly means having spring blades. This temporary swelling of the perforated mask causes displacements of the slots which, in the center, are exclusively axial; they present axial components decreasing from the center towards the periphery (where they are initially zero) and radial components which increase from the center (where they are nil) until about halfway between the center and the edge (where they reach their maximal values) and from there said components decrease towards this periphery. This situation is diagrammatically illustrated in the sectional view of FIG. 1, where a curve A in dashed line shows the profile of a cold mask 12 and a cold frame 16, while a curve B in mixed lines shows the profile of a hot mask 12 with a cold frame 16 causing the said swelling. The abovementioned displacements of the slots have the effect of displacing the axes of those portions of the beams which cross through them with respect to the vertical axes of the bands of luminescent material R, V and B, associated in juxtaposed triplets, in such a way as to cause register losses, or alignment defects, that are the highest in an annular zone located about mid-way between the center and the edge of mask 12.

This can result in either a relative decrease of the luminous intensity substantially proportional to that of the surface of the bombarded luminescent material (if the bands are separated by phosphorous-free zones), or defects of color purity, since a beam intended for a single luminescent material hits partially an adjacent band of another color.

After a selected operating time of the tube, the frame 16 is also heated progressively, by conduction, by radiation and possibly by electron bombardment. Since the frame 16 and mask 12 are generally made of the same material (laminated steel), they present the same thermal expansion coefficient. The expansion of frame 16, resulting from that of mask 12, has the effect, on the one hand, of reducing its swelling (by flattening it with respect to the curve B of FIG. 1), and on the other hand, of increasing the shift between its slots, i.e. of displacing them radially. This is diagrammatically illustrated in the sectional view in FIG. 2, which shows (curve A in dashed line, analogous to that of FIG. 1) the profile of a cold mask-plus-frame assembly and (curve C in full line) a hot mask-plus-frame assembly, i.e. a mask and frame having reached a same equilibrium temperature. It is observed that the size of mask 12 as well as the shift between the pairs of parallel arms of frame 16 have increased and that the radius of curvature of mask 12, after a brief reduction due to the initial swelling, becomes slightly higher than that which had prevailed in the cold state. If frame 16 is suspended solely by using spring blades the longitudinal axes of which are positioned in a single median (transverse) plane and are substantially tangential with respect to its circumference, frame 16 can expand in its plane without undergoing any axial displacement. This has the effect of stretching the surface of the mask so that it spreads out by flattening slightly. Mask 12 thus undergoes a slight axial displacement at the center which increases with the radial distance, and a spreading out in the radial direction which has the effect of producing an increase of the spacing of the slots and, to a lesser extent, an increase of their width. This results in register losses due to the spreading out of the slots in the plane of the expanded surface, which increase with their radial distance with respect to the axis of the tube (i.e. with respect to the center of the mask 12). It has been determined that a supplementary displacement of the hot mask-plus-frame 16 assembly (profile C) in the direction of the screen by following the axis of the tube, allowed to compensate these register losses, such a displacement allowing substantially to maintain the center of curvature of the surface of mask 12 at the intersection of the axis of the tube with the deviation plane perpendicular to this axis. This axial displacement towards the fore, illustrated by profile D (without frame) in FIG. 2, is obtained either by blade springs (cf. for example, French Patent application published under no. 1 540 869), or by using a double blade component inserted between one end of the blade spring and frame 16. However, these double blade or bimetallic compensation elements are not involved during the initial swelling of mask 12. This swelling can be especially reduced, as well as other distortion effect exerted on the edges of mask 12, by limiting the number of welding sites or sealings joining the skirt of the mask 12 to the belt of frame 16 that are parallel, as disclosed in French patent application published under no. 1 470 260.

Various arrangements have allowed supplementary reductions of initial swelling to be achieved both in amplitude and duration. In particular, it is possible with this purpose, to utilize a frame of reduced thickness, strengthened by at least one rib or fold in order to present sufficient mechanical strength. It is also possible, and this is the system used in the present invention, to use two strips or blades as intermediary attachment means between the mask and the lateral wall of a frame (cf. for example, German patent No. 2 713 246).

But known double-blade or bimetallic strips present complex shapes and are consequently expensive to produce, which is a particularly serious drawback for mass produced appliances.

BRIEF DESCRIPTION OF THE INVENTION

The invention allows to produce bimetallic strips having a simple shape and which are therefore inexpensive without impairing the quality of the reduction of the initial swelling of the mask.

According to the invention, the strips disposed between the edge of the mask and the frame are flat with, preferably, a rectangular profile.

When the edge of the mask is inside the frame, said frame presents projections to which are welded the first ends of the flat bimetallic strips, the second ends being welded to the edge of the mask, so that this edge is at a distance from the corresponding wall of the frame, so as to allow the expansion of the mask within the frame.

In an embodiment that can be used, when the edge of the mask is either inside or outside the frame, a section of the end of each flat strip is welded to the bottom of a corresponding recess provided in the frame. The width of the recess is, of course, greater than the width of the strip. When the edge of the mask is inside the frame, it is preferable that the bottom of the recess be projecting inside the frame. When the edge of the mask is outside the frame, the external face of the strip can be substantially coplanar with the external face of the frame.

BRIEF DESCRIPTION OF THE DRAWINGS

The invention will be better understood and its objects, features and advantages will become more apparent from the following description given with reference to the appended drawings in which.

DETAILED DESCRIPTION OF THE INVENTION

Figure 1:
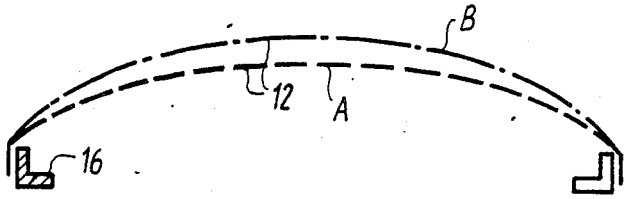
FIGS. 1 and 2 described hereinabove, are diagrammatical sections of the mask-plus-frame assembly of a color television tube.
Figure 2:
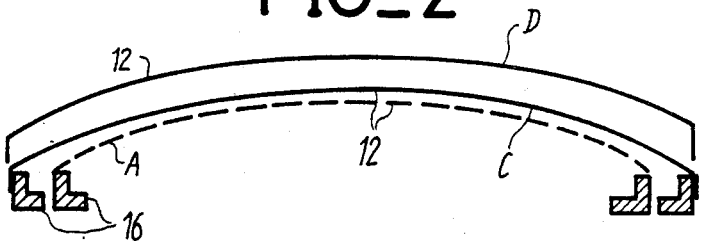

The temporary swelling, upon turning the tube on, of mask 12 with respect to the frame 16 is reduced by rendering possible the expansion in the radial direction of the mask to occur practically independently from that of the frame.

The examples that will be described refer to a lined trichrome screen and a slotted rectangular mask. For such tubes, there are theoretically no register defects in the direction of the triplets (i.e. vertical); it is sufficient to utilize bimetallic strips (or blades) blades 26 solely on the vertical sides, the top and the bottom of skirt 24 of the mask 12 being preferably directly welded, for example, in 2, 3 or 4 points, to lateral wall 18 (FIG. 4) of frame 16, in order to reduce the cost.

Figure 3:
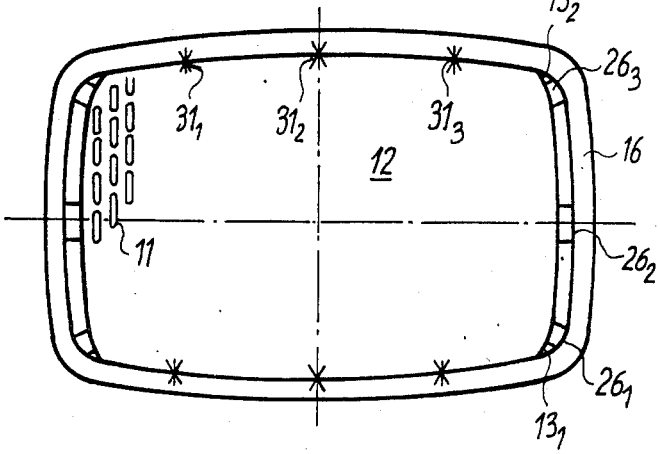
FIG. 3 is a diagrammatical front view indicating the locations of the bimetallic strips.

FIG. 3 is a diagrammatical frontal view indicating respectively the locations of the connecting bimetallic strips 26 and the welds, of a mask-plus-frame assembly according to the invention.

Each of the vertical sides, left and right, of the skirt of mask 12 with slots 11 is joined to the adjacent side of the girdle 180 of the frame, by means of three bimetallic lugs 26, one of which $\mathbf{26_2}$ is disposed in the middle of the side involved while the two others $\mathbf{26_1}$ and $\mathbf{26_3}$, symmetrically on either side of this center adJacent to sides $\mathbf{13_1}$ and $\mathbf{13_2}$.

Since the expansion of mask 12 in the diagonal direction is greater than that in the direction of its horizontal axis of symmetry, a greater flexion than for the bimetallic strip $\mathbf{26_2}$ is chosen for strips $\mathbf{26_1}$ and $\mathbf{26_3}$ placed in the corners. This greater flexion can be obtained, especially by increasing the difference between the heat expansion coefficients of the respective constitutive alloys of the superimposed blades which are joined together so as to constitute the bimetallic strips. It is also possible to vary the length of bimetallic strip 26 in order to obtain a smaller or a greater displacement of its end attached to skirt 24.

The long horizontal sides of the frame and the skirt are directly joined together, for example, by three welding spots $\mathbf{31_1}$, $\mathbf{31_2}$ and $\mathbf{31_3}$, one of which $\mathbf{31_2}$ is in the middle while the two others $\mathbf{31_1}$ and $\mathbf{31_3}$ are located symmetrically on either side of this median position. Experience has demonstrated that it can be advantageous to place spot welds $31_1$ and $31_3$ at distances from the middle $31_2$ that are smaller than one quarter of the total length from the top or the bottom of the skirt, w1th a view to reducing a possible curvilinear distortion of the elongated form of slots 11.

FIGS. 4, 6, 8 and 10 are sectional views showing details of embodiments of the embodiments of mask-plus-frame assemblies using flat bimetallic strips and FIGS. 5, 7, 9 and 11 are views in perspective of these flat strips utilized in the assemblies of the figures described hereinabove.

Figure 4:
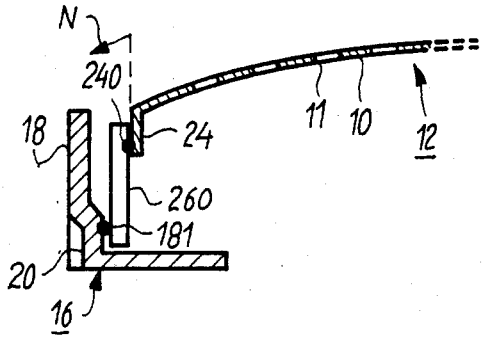
FIGS. 4, 6, 8 and 10 are sectional views showing details of embodiments, according to the invention, of assemblies of the mask and frame using bimetallic strips.
Figure 5:
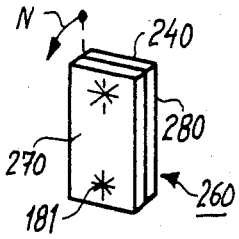
FIGS. 5, 7, 9 and 11 are perspective views of the bimetallic elements of the assemblies shown respectively in FIGS. 4, 6, 8 and 10.

FIG. 4 shows the utilization of a frame 16, the lateral wall 18 of which is provided in its lower portion with recesses or hollows 20 that constitute regularly spaced apart projections towards the inside of this lateral wall 18, so that the plane defined by the internal surface is spaced apart from the remainder of the internal face of wall 18 in such a way that is sufficient to allow the flat strips 260 shown in FIG. 5 to be used. Each bimetallic strip is composed of a blade 270 of low expansion and a blade 280 of high expansion superimposed and joined together, the first blade 270 of which is joined at its lower end to the internal face of recess 20, by a spot weld 181 and the second blade 280 of which, is Joined at its upper end to the external face of skirt 24, by another spot weld 240. When heated, bimetallic strip 260 undergoes a bending towards the outside, analog to a pivoting motion in the direction of the arrow N around its attachment point 181 to the frame 16.

Blade 270, one end of which is welded at a point 181 to girdle 18 of frame 16, is preferably made of a nickel iron alloy (30–40% nickel for example), having a low heat expansion coefficient (and generally known under the denomination of INVAR). The other blade 280, the end of which is welded at a point 240 to the skirt 24 of mask 12, is made of steel, for example cold-rolled steel (like the mask and the frame) and Presents a high heat expansion coefficient.

Figure 6:
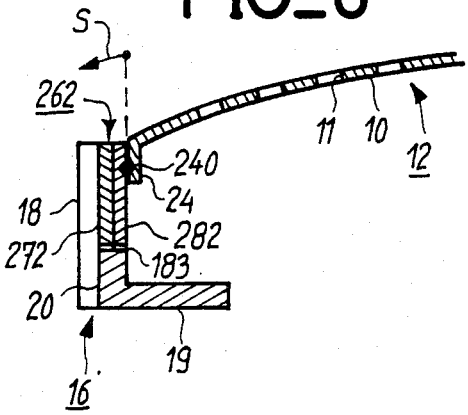
Figure 7:
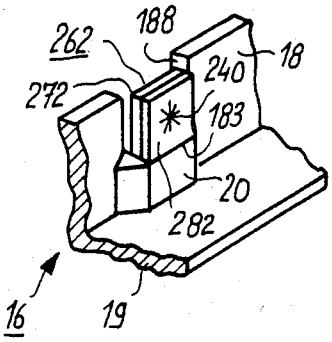

FIGS. 6 and 7 show details, respectively in section and in perspective of another embodiment of a mask-plus-frame assembly using flat intermediary bimetallic strips. Frame 16 is of the type having spaced recesses 20, as shown in FIG. 4.

Above these recesses 20, lateral wall 18 is provided with cut-outs or crenels 188, the flat bottom of which, parallel to the base 19 of frame 16, is shifted towards the axis of the tube (inside) with respect to the upper edge of lateral wall 18. In a with recess 20, the whole lower side of a flat bimetallic strip 262, analog to that represented in FIG. 5, is welded at 183 on said flat bottom. This bimetallic strip 262 comprises a low expansion lamina 272 turned towards the outside (opposite to the axis of the tube) and a high expansion lamina 282 turned towards the inside, both laminae being superimposed and welded together. The top of the internal face of lug 262 is welded at 240 to the external face of the skirt 24. During the rise in temperature, spot weld 240 is displaced according to arrow S towards the outside so that lugs 262 stretch mask 12.

FIGS. 4, 5, 6 and 7 show mask-plus-frame type assemblies wherein the skirt 24 is located inside the lateral wall 18, 180 of the frame. In this case, the expansion compensating the swelling, which result from the use of the bimetallic strips is limited to the width of the interval between the external face of skirt 24 and the internal face of girdle 18 or 180. This limitation is non-existent in the type of mask where the skirt 24 surrounds the lateral wall 180 of the frame.

Figure 8:
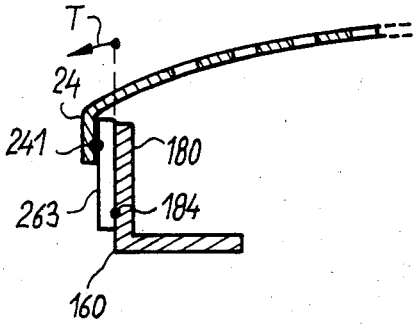
Figure 9:
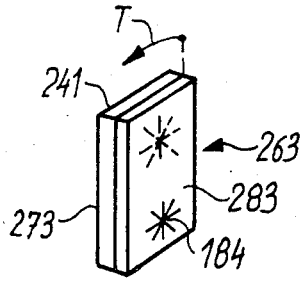

FIG. 8 is a sectional view of a detail of the most simple embodiment of a mask-plus-frame assembly of the type having an external skirt and using a flat bimetallic strip 263, represented in a perspective view in FIG. 9.

This bimetallic strip 263 is comprised of a lamina of low expansion 273 and a lamina of high expansion 283, superimposed and joined together. The lower end of the accessible face of lamina 283 is joined by a spot weld 184 to the bottom of the external face of the lateral wall 180 of frame 160. The top of the accessible face of the lamina 273 is welded at 241 to the internal face of skirt 24. During the rise in temperature of bimetallic strip 263, the top of the said strip moves away from lateral wall 180 of the frame 160, as shown symbolically by arrow T.

Figure 10:
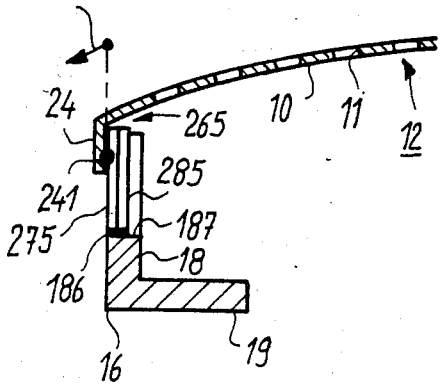
Figure 11:
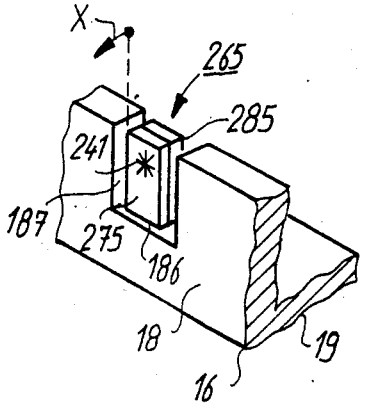

In the example of FIGS. 10 and 11, there is used a frame 16 the substantially flat lateral wall 18 of which (without recesses or projections) is provided with crenel-shaped cut-outs 187 allowing to position therein the flat rectangular bimetallic strips, each of which comprises a 1ow expansion 1amina 275 and a high expansion lamina, superimposed and welded together over their entire interface, similar to bimetallic strips 260, 262, 263 of FIGS. 5, 7 and 9.

The bottom of cut-out 187 is flat and parallel to the base 19 of frame 16 in such a way as to be able to bear the lower end of bimetallic strip 265 which is joined to this bottom by a weld 186.

In order that heating of the bimetallic strip 265 results in a bending so that its free end is displaced towards the outside according to arrow X, lamina 275 is turned towards the outside and lamina 285 towards the inside or the axis of the tube.

The accessible face of low expansion lamina 275 can be disposed in alignment with the external face of the lateral wall of girdle 18 or slightly projecting with respect to it, the inside face of skirt 24 of the mask 12 being joined by a weld 241 to the upper part of the external face of bimetallic strip 265. When this face is coplanar with that of girdle 18, the inside face of the skirt can be in contact with the outside face of girdle 18 at the beginning of operating of the tube, which eventually allows a more rapid heating of frame 16 to be effected, especially with respect to the horizontal lateral arms (left and right).

In the embodiments represented in FIGS. 6, 7, 10 and 11, where frame 16 is provided with crenel-shaped cut-outs to house bimetallic strips 262 or 265, this frame is weakened by said cut-outs and must have a sufficient thickness in order to compensate this weakening. In the other embodiments, the utilization of a light frame 160 can be advantageous from the point of view, on the one hand, of the reduction of the temporary swelling as to its amplitude and its duration and, on the other hand, of the compensation of the overall expansion of the frame and the mask generally, said compensation being ensured by classical bimetallic strip assemblies, with which the suspension springs of the frame to the frontal sheet of the tube are equipped, since the more rapid rise in temperature of the light frame favors that of the bimetallic elements which are welded to it.

Figure 12:
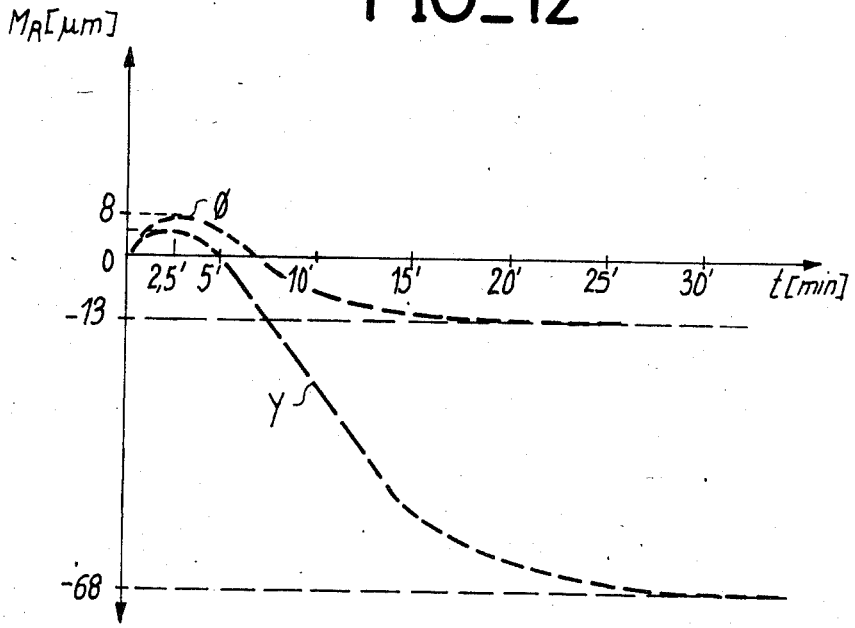
FIG. 12 shows diagrams representing the variation of register losses as a function of the operating time of the tube.

The effects the bimetallic strips 26 or 260 on the behavior of the mask 12, i.e. the register defect variation $M_R$ with the operating time t is illustrated by FIG. 12.

In abscissae the time $t=0$ corresponds to the turning-on of the tube, and in ordinates the alignment defect or register defect $M_R$ is measured by the shift of the axis of a fine excitation beam of a single color with respect to the vertical median axis of the strip of luminescent material of the same color for a point situated on the horizontal median axis of the screen, generally half-way between the center and the edge of the trichrome line. A radial shift towards the center is positive and a shift towards the edge is negative.

The curves of FIG. 12 have been traced for a temperature rise from 25° to 55°. Curve Y corresponds to a mask-plus-frame assembly according to the invention, but without the conventional compensation means ensuring the drawing together of the mask-plus-frame assembly of the screen by its axial displacement towards the fore while curve $\phi$ refers to a mask-plus-frame assembly according to the invention, comprising furthermore the said conventional compensation means constituted by bimetallic strips located between the frame and the spring suspension on the glass plate.

From FIG. 12 it can be deduced that the bimetallic strips placed between the frame and the mask and arranged according to FIG. 5 allow to reduce the register defect (here positive) due to the temporary swelling, whereas in the absence of compensating means between the frame and the glass plate, the overall expansion of the frame-mask assembly reached after about 30 minutes remains important. The provision of known compensating means very slightly increases the temporary swelling (positive value of $M_R$) but brings the global expansion back to a low value.

I claim:

1. A colored image tube comprising:

a glass tube envelope;

a frame attached to an interior surface of the envelope, adjacent to a screen section of the envelope;

a shadow mask having a peripheral edge and made of material similar to that of the frame so that both mask and frame exhibit substantially the same coefficient of thermal expansion;

a plurality of planar bimetallic strips welded at opposite end portions thereof to the frame and the mask edge;

the bimetallic strips exhibiting displacement upon initial operational warm-up of the tube to compensate for greater expansion of the mask relative to the frame during initial tube warm-up.

2. A tube according to claim 1, wherein the edge of the mask is inside the frame, and wherein a first end of each bimetallic strip is welded to a projection inside the frame and a second end of the same strip being welded to the edge of the mask for providing a space between a corrsponding arm of the frame and the edge of the mask.

3. A tube according to claim 1, wherein each bimetallic strip has a generally rectangular shape.

4. A tube according to claim 1, wherein each bimetallic strip is formed of two superimposed laminae, the internal lamina having the higher heat expansion coefficient.

5. A colored image tube comprising: a metallic perforated mask with thermal expansion for the selection of colors in order that an electron beam intended for a particular color only reaches, on the screen, the luminescent material of that color, the mask presenting an edge fixed to a frame through intermediate bimetallic strips, the frame being integral with the internal face of the glass wall of the tube adjacent to the screen, wherein the bimetallic strips between the edge of the mask and the frame are completely flat, and wherein each flat bimetallic strip has an end surface welded to the bottom of a recess of the frame and a face welded to the edge of the mask, the width of the recess being greater than the width of the corresponding bimetallic strip.

6. A tube according to claim 5, wherein the edge of the mask is inside the frame, and wherein the bottom of the recess of this frame is projected inside the frame for providing a space between a corresponding arm of the frame and the edge of the mask.

7. A tube according to claim 5, wherein the edge of the mask is outside the frame, and wherein the external face of the bimetallic strip is substantially coplanar with the external face of the frame.

* * * * *